US007543594B2

(12) United States Patent
Novak

(10) Patent No.: US 7,543,594 B2
(45) Date of Patent: Jun. 9, 2009

(54) SHELTER VACUUM HOLD DOWN DEVICE

(76) Inventor: Edward L. Novak, 7028 Cornell, University City, MO (US) 63130

( * ) Notice: Subject to any disclaimer, the term of this patent is extended or adjusted under 35 U.S.C. 154(b) by 0 days.

(21) Appl. No.: 11/585,446

(22) Filed: Oct. 24, 2006

(65) Prior Publication Data

US 2008/0142061 A1 Jun. 19, 2008

(51) Int. Cl.
*E04H 15/56* (2006.01)

(52) U.S. Cl. ..... 135/116; 135/137; 52/2.13

(58) Field of Classification Search ..... 135/116, 135/137, 91, 92, 93, 115; 52/218, 2.11, 2.13, 52/2.14, 2.18; 248/362, 309.3; 451/494; 47/32.1

See application file for complete search history.

(56) References Cited

U.S. PATENT DOCUMENTS 2,976,875 A * 3/1961 Hoffman ..... 52/2.16
3,170,472 A 2/1965 Cushman
3,181,543 A * 5/1965 Petrie ..... 135/92
3,335,529 A 8/1967 Gedney
4,020,607 A * 5/1977 Bjervig ..... 52/173.2
4,707,953 A * 11/1987 Anderson et al. ..... 52/63
4,735,638 A * 4/1988 Ciliberti et al. ..... 55/302
4,881,711 A * 11/1989 Vollaro ..... 248/362
4,979,532 A * 12/1990 Johansson et al. ..... 135/97
5,007,212 A * 4/1991 Fritts et al. ..... 52/2.18
5,041,315 A * 8/1991 Searle et al. ..... 428/34.4
5,260,714 A * 11/1993 DeCook et al. ..... 347/264
5,487,400 A * 1/1996 Dawkins ..... 135/87
5,502,927 A * 4/1996 Hammerton ..... 52/218
5,615,521 A * 4/1997 Simerka ..... 52/2.22
5,636,478 A * 6/1997 Chen ..... 52/2.11
5,642,750 A * 7/1997 Brown et al. ..... 135/137
5,893,237 A * 4/1999 Ryon et al. ..... 52/2.18
6,596,374 B1 * 7/2003 Adjeleian ..... 428/131
6,698,715 B2 * 3/2004 Smith et al. ..... 251/174
7,275,725 B2 * 10/2007 Kimura ..... 248/205.9
2005/0079077 A1 * 4/2005 Tsai et al. ..... 417/423.15
2006/0041259 A1 * 2/2006 Paul et al. ..... 606/61

* cited by examiner

*Primary Examiner*—David Dunn
*Assistant Examiner*—James Alex
(74) *Attorney, Agent, or Firm*—Mark Manley

(57) ABSTRACT

An air supported positively pressurized flexible material shelter for use on a surface comprising a flexible wall and a skirt connected to the wall and surrounding the flexible wall. A source of vacuum being propagated beneath the skirt along the flexible wall, to vacuum the skirt down to the surface to secure the temporary shelter to the surface. The skirt forms a continuous connection with the surface around the entire perimeter of the shelter. An optional flexible seal is provided essentially parallel to a vacuum channel and on an exterior edge of the skirt spaced from the flexible wall.

11 Claims, 5 Drawing Sheets

SHELTER VACUUM HOLD DOWN DEVICE

CROSS REFERENCES TO RELATED APPLICATIONS

Statement as to Rights to inventions made under Federally sponsored research and development: Not applicable.

BACKGROUND OF THE INVENTION

1. Field of the Invention

This present invention relates generally to shelters and to anchoring devices for shelters.

2. Background Information

Temporary shelters are commonly used for recreation, community events as well as in emergencies. In emergencies it is desirable to be able to quickly erect shelters for a variety of purposes. Often emergency shelters are inflated on site. Inflatable shelters have the advantage of being quick to erect and do not require a separate heavy frame. Shelters with inflatable beams give shelter that is quick to erect, strong and that have a maximum area of covered space for the transportation weight. However, inflatable shelters do have problems. The light weight of the shelters gives a shelter that can move easily. One problem with inflatable shelters is that they tend to fill into the shape of a sphere or cylinder like a balloon. Such a shelter has a minimum of usable floor space. Even if heavy objects are placed on the floor of an inflatable shelter to hold the floor down, the upward force of the shelter combined with movement of people in the shelter can cause movement of even fairly heavy objects. Another problem with inflatable shelters is the need for destructive stakes. Stakes are used to tie the structure down to force the inflated structure to have a flat section of floor. This can require a tremendous amount of force and requires a very substantial staking process. Even when staked, there tends to still be unusable space near the walls where the floor still lifts up into a non-flat configuration. Another problem with inflatables is that they can be damaged during the inflation process when they are typically not yet tied down. If inflated on a parking lot, a wind can rake havoc. Another problem with existing inflatable shelters is that the movement of the floors and walls can cause motion sickness to those inside. To solve these problems, the prior art has used tie downs and stakes to secure temporary shelters. However, in emergency situations it is common to erect shelters on pavement such as in a parking lot or even inside a larger building such as a warehouse, gymnasium or sports stadium. In these cases driving stakes into concrete or other floor surfaces is destructive to the facility and also eliminates much of the benefit of an easy to erect building.

A further problem with positively pressured inflatable structures is the tendency for an inflatable shelter to form rounded edges instead of square edges. This tends to yield a floor that does not lay flat all the way to the edges of the floor, rather the edges curl up and as a result usable floor area is reduced. There is often a trip hazard in doorways where the floor of the shelter tends to lift off the underlying surface. Personnel movement on lifted areas result in shelter motion. To correct this problem with the prior art, more staking has been used. To get a truly flat floor it is necessary to stake frequently around the entire perimeter of the structure which greatly increases the time and cost of installation as well as the destructive aspect to the existing concrete surface, floor or pavement. Stake loads increase dramatically with internal pressure on an inflatable shelter. Stresses in the shelter material increase dramatically as the floor/wall interface approaches a sharp corner.

Accordingly, there is a need for an improved method and apparatus to affix a flexible fabric shelter to a surface.

SUMMARY OF THE INVENTION

The present invention solves the problems outlined above. The invention anchors the shelter to the deployment surface by applying vacuum beneath the shelter floor causing atmospheric pressure bearing on the shelter floor to hold it against the deployment surface.

In one aspect of the invention a shelter for use on a deployment surface has a flexible wall and a skirt surrounding the flexible wall and connected to a bottom edge of the wall. A source of vacuum supplied to a plurality of points beneath the skirt to hold the entire flexible skirt and the bottom edges of the wall flat on the surface. The atmosphere can exert a net hold down force upon the shelter being equal to the vacuum pressure multiplied by the shelter floor area. Additional features and benefits will become apparent from the detailed disclosure and claims.

DESCRIPTION OF THE PREFERRED EMBODIMENTS

Figure 1:
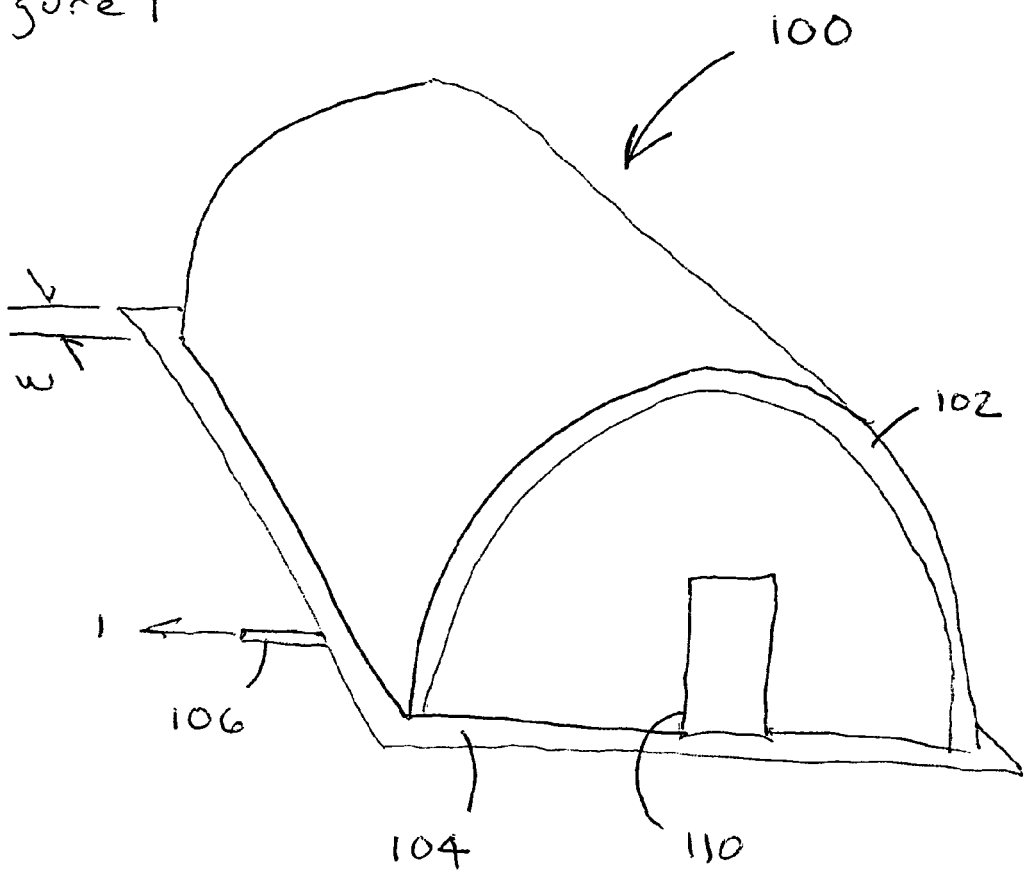
FIG. 1 is a view of the shelter.

FIG. 1 illustrates a preferred embodiment of the shelter 100. The shelter 100 is supported by air pressure in the shelter 100 such that the shelter 100 can be erected in the field simply by inflating the shelter 100. The shelter could also be supported by positive pressure filling air beams 102 or alternatively the shelter could be supported by a frame. The shelter includes a flexible skirt 104 connects to the wall (120 in FIG. 2) along the perimeter of the wall. A peripheral border having a width 'W' is formed around the interior portion of the shelter 100. A source of vacuum 106 is supplied under the flexible sealing skirt 104. The shelter 100 can include openings such as a door 110. The source of vacuum 106 vacuums the flexible sealing skirt 104 down to a deployment surface 'S' that the shelter 100 is erected upon. The surface 'S' can be a concrete floor inside a building, asphalt, a wood floor or a composite gymnasium floor for example. The device has been tested and shown to be successful on concrete, asphalt, wood, or carpet surfaces. The system also works on other surfaces. The skirt 104 material is important. Some fabric materials are relatively rigid or stiff, these con be strong but will not conform to a deployment surface as well as a soft material that easily conforms to a surface.

Figure 2:
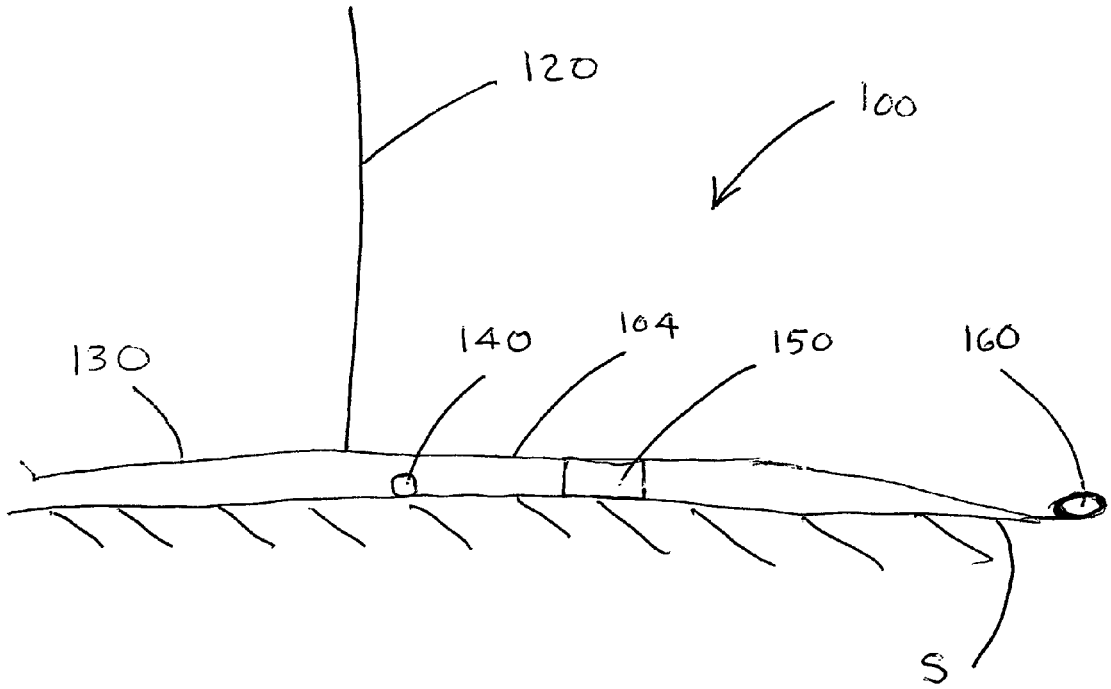
FIG. 2 shows details of the invention.

FIG. 2 shows a partial cross section of the shelter 100 revealing details of the invention. The shelter 100 includes a flexible wall 120 and a floor 130. The wall 120 is connected to a skirt 104 that surrounds the floor 130 and living space within the shelter 100. The shelter 100 sits on a deployment surface 'S' such as a floor or parking lot for example where the temporary shelter 100 might be required. Vacuum channel 140 propagates vacuum beneath the entire perimeter of the skirt 104. The skirt 104 is sealed to the deployment surface S by the crushing force of atmospheric pressure. Additional seals 150 may be applied beneath the skirt 104 where discontinuities exist on the deployment surface S for example. Additional sealing may consist of compressible seal 150 for example and seal enabler 160. The compressible seal 150 can be any light weight compressible material such as foam rubber. The auxiliary seal 160 can be any weight and could consist of sand or sand bags for example.

The cross section of FIG. 2 shows a vacuum channel 140 that carries the vacuum to areas covered by the skirt 104. The skirt 104 can be sealed by a flexible seal 150 and an auxiliary seal enabler material 160 as an option to improve anchoring. The auxiliary seal enabler material 160 could be loose sand or sand bags stacked along the edge of the skirt 104 to improve sealing. When vacuum is applied, vacuum will communicate with the spiral openings 144 (FIG. 3) in the channel 140 and the skirt 104 will pull down around the vacuum channel 140 and the seal 150, which can be a flexible material such as a sponge like foam for example, will flatten. It will be understood by those in the art that the skirt can be attached to the floor surface of the shelter interior. It will also be understood that the vacuum could be applied under the floor of the shelter instead of using a perimeter skirt. The channel 140 could be a part of the skirt 104, it is known to supply material that includes channels to communicate vacuum.

Figure 3:
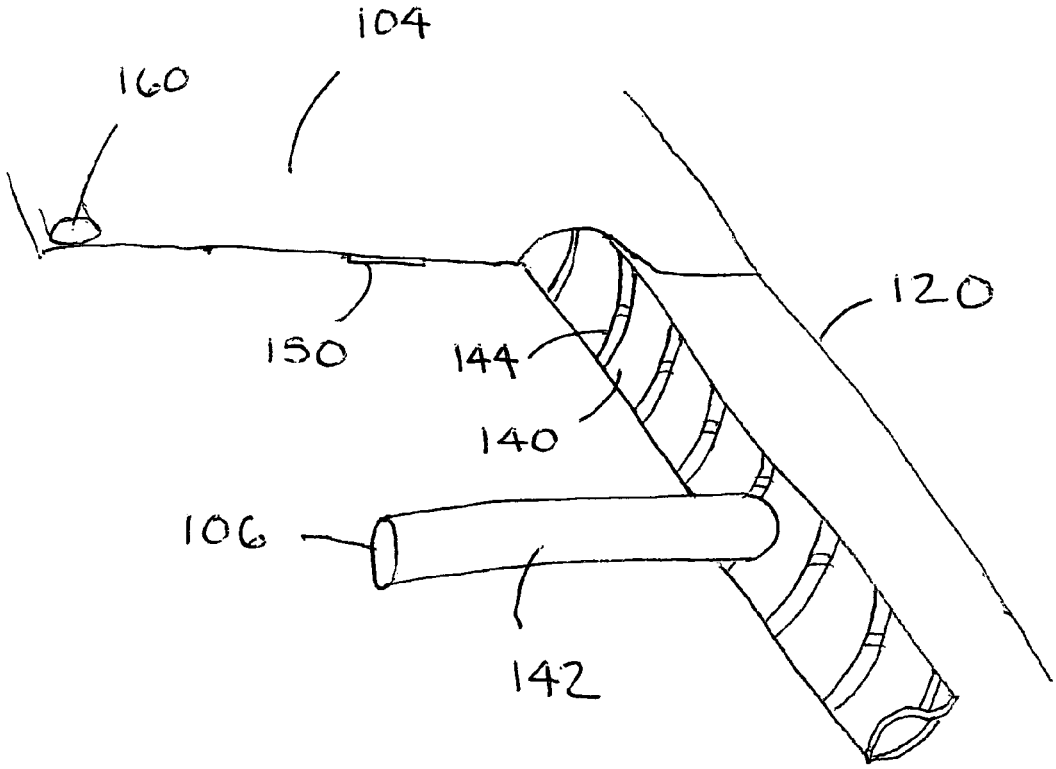
FIG. 3 shows additional details of the invention.

FIG. 3 shows that the vacuum channel 140 receives vacuum source 142 connected to a source of vacuum 106. The vacuum channel 140 propagates vacuum to the under surface of the skirt 104 which is shown partially cutaway in FIG. 3. The seal 150 is shown as it will appear when vacuum is applied, the skirt has wrapped tight around the vacuum channel 144. The purpose of the vacuum channel 144 is to provide a conduit around the entire perimeter of the wall 120. In this case the vacuum channel 140 is shown as a plastic spiral conduit material with openings 144. The channel 140 provides a skeleton that will not collapse under the force of the vacuum and atmospheric pressure and yet allows is porous and allows a portion of the vacuum to be applied at regular intervals around the shelter perimeter. The spiral wrap shown has a diameter of about ½ inch and a wall thickness of about $1/16^{th}$ inch and a 1/16 inch spiral opening at about ½ inch intervals over the entire length of material. When covered with the skirt 104 the vacuum channel 140 forms a vacuum conduit.

Figure 4:
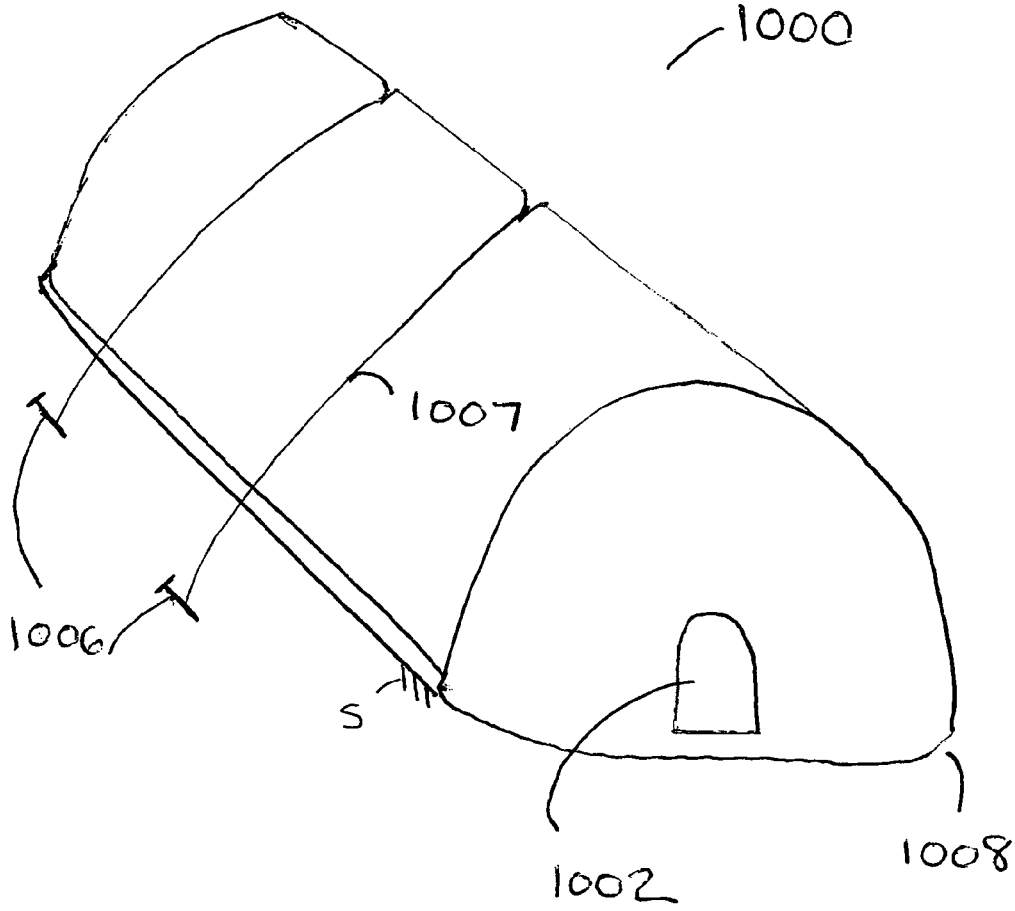
Figure4 Prior Art
FIG. 4 shows details of the prior art.

FIG. 4 shows a portion of a prior art shelter 1000 including a door 1002 The shelter 1000 can have stakes 1006 at multiple points along its length to the surface 'S'. The stakes 1006 can support ropes 1007 that exert tremendous pressure on the shelter 1000 to hold it in a near half cylinder shape against internal positive pressure. As can be seen, edges and corners 1008 still curl up off the deployment surface. Going inside the shelter 1000 and stepping on one of these corners 1008 will cause the entire shelter 1000 structure to move and will cause other parts of the shelter floor to lift up. The raised areas substantially reduce the useful area inside the prior art shelter 1000 and as can be seen can create walking problems such as the trip hazard at the door 1002 where the bottom of the door 1002 can be raised up off the ground.

Figure 5:
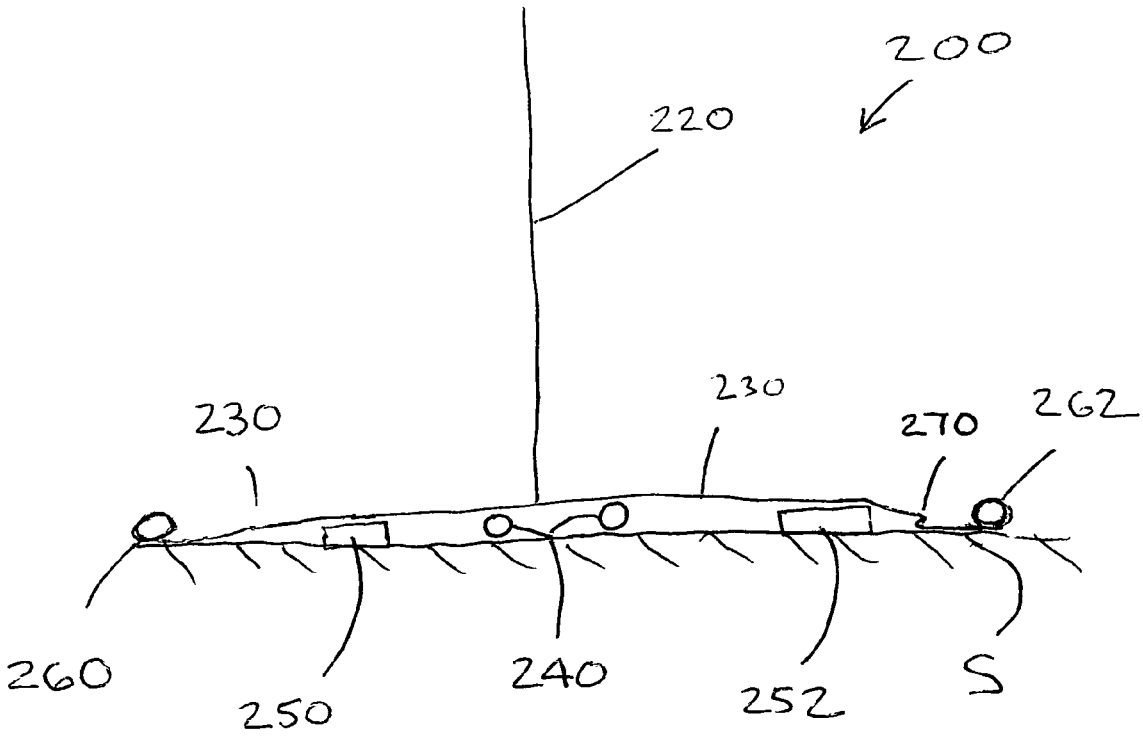
FIG. 5 shows an alternate embodiment of the invention.

FIG. 5 shows an alternate embodiment of the shelter 200. In this case a flexible wall 220 sits on top of a flexible skirt 230 that extends to both sides of the wall 220. Vacuum is supplied through a channel 240 that runs along the length of the wall 220 just beneath the wall 220. An optional seal 250 and 252 is provided on each side of the vacuum channel 240 and runs the length of the wall 220 and channel 240. An additional seal enabler 260, 262 can be provided at the edge of or on top of the skirt 230 furthest removed from the wall 220. The additional seal enabler 260, 262 might, for example be a material used to enhance the seal on rough concrete or grass for example. For example, the additional seal material could be a liquid material or sand or sand bags or gravel or dirt for example. Many materials would work. It will be understood that the wall 220 might separate the interior of a shelter from the exterior for example such that the vacuum is applied both under a skirt and a floor of the shelter 200. FIG. 5 also shows that the skirt 230 can have an optional seal formed by fabric overlap 270 formed along its length. It has been found that this overlap 270 can also help in forming the seal.

It will be obvious to those skilled In the art that modifications may be made to the embodiments described above without departing from the scope of the invention. Thus the scope of the invention should be determined by the claims in the formal application and their legal equivalents, rather than by the examples given.

I claim:

1. A shelter for use on a surface comprising;

a flexible wall;

a skirt surrounding the flexible wall and connected to said wall, a source of vacuum, a channel propagating said vacuum to a plurality of points beneath said skirt beneath said flexible wall, wherein said channel includes, a spiral tubular skeleton beneath said skirt, said spiral tubular skeleton including spiral openings to communicate vacuum from said source of vacuum to said plurality of points and wherein said spiral tubular skeleton will not collapse as vacuum is applied to said skirt.

2. The shelter of claim 1 wherein said shelter is supported by air pressure in at least a portion of said shelter and wherein as vacuum is applied to said skirt said skirt pulls down around said channel.

3. The shelter of claim 1 including an optional seal enabler on top of said skirt and a compressible seal under the skirt that is compressed under said seal enabler to form a seal.

4. The shelter of claim 3 wherein said compressible seal collapses to create a seal when vacuum is supplied to said plurality of points.

5. The shelter of claim 3 wherein said seal enabler is at least one sand bag placed on said skirt and said compressible seal is compressible foam.

6. The shelter of claim 3 wherein the seal enabler is at least one material chosen from the list of sand or dirt or gravel.

7. A combination wall and non-destructive anchoring system for use on a surface comprising;

a wall;

a skirt surrounding the wall and connected to said wall, a source, of vacuum, a channel communicating said vacuum beneath said skirt to a plurality of points along a perimeter of said wall, such that said wall is attached to said surface by said vacuum, wherein said channel includes a spiral tubular skeleton beneath said skirt, said spiral tubular skeleton including spiral openings to communicate vacuum from a said source of vacuum to said plurality of points and wherein as vacuum is applied to said skirt said skirt pulls down around said tubular skeleton.

8. The combination of claim 7 wherein said wall is a flexible fabric wall and wherein said channel will not collapse as vacuum is applied to said skirt.

9. The combination of claim 7 wherein the wall is part of a shelter and the shelter is supported by positive pressure supplied to an interior of the shelter.

10. The combination of claim 7 including an optional seal enabler on top of said skirt and a compressible foam seal surrounding said perimeter.

11. The shelter of claim 7 wherein said skirt includes an optional first seal including a flexible material under said skirt that collapses when vacuum is supplied to said plurality of points.

* * * * *